US008303162B2

(12) United States Patent
Jagle

(10) Patent No.: US 8,303,162 B2
(45) Date of Patent: Nov. 6, 2012

(54) MIXING DEVICE WITH STATOR HAVING GROOVED PULVERIZING EDGES AND ROTOR FOR PUMPING

(75) Inventor: Peter Jagle, Ballrechten-Dottingen (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 0 days.

(21) Appl. No.: 13/130,379

(22) PCT Filed: Dec. 7, 2009

(86) PCT No.: PCT/EP2009/008721

§ 371 (c)(1),
(2), (4) Date: May 20, 2011

(87) PCT Pub. No.: WO2010/072321

PCT Pub. Date: Jul. 1, 2010

(65) Prior Publication Data

US 2011/0220751 A1 Sep. 15, 2011

(30) Foreign Application Priority Data

Dec. 16, 2008 (DE) ..... 10 2008 062 570

(51) Int. Cl.
*B01F 7/00* (2006.01)

(52) U.S. Cl. ..... 366/129; 366/305

(58) Field of Classification Search ..... 366/129, 366/279, 262–265, 270, 302, 305, 342–343; 241/2, 46.11, 246, 101.8; 435/316.1, 306.1
See application file for complete search history.

(56) References Cited

U.S. PATENT DOCUMENTS 3,251,580 A * 5/1966 Adams ..... 366/343
3,556,414 A * 1/1971 Eberly, Jr. ..... 241/1
3,666,187 A * 5/1972 Norris ..... 241/89.4
3,724,765 A * 4/1973 Rohrbaugh et al. ..... 241/46.06
3,887,144 A * 6/1975 Schaeffer ..... 241/301
4,002,326 A * 1/1977 Brogli et al. ..... 366/264
4,307,846 A * 12/1981 Spelsberg ..... 241/246
4,366,930 A * 1/1983 Trombetti, Jr. ..... 241/169
4,505,433 A * 3/1985 Selenke ..... 241/46.01
4,745,068 A * 5/1988 Godfrey et al. ..... 435/306.1
4,828,395 A * 5/1989 Saito et al. ..... 366/143
5,174,508 A * 12/1992 Martin ..... 241/21
5,390,859 A * 2/1995 Rajasekaran ..... 241/2
5,533,683 A * 7/1996 Fay et al. ..... 241/169
5,731,199 A * 3/1998 Roggero ..... 435/306.1

(Continued)

FOREIGN PATENT DOCUMENTS

DE 202004003045 5/2004

(Continued)

*Primary Examiner* — Charles E Cooley
(74) *Attorney, Agent, or Firm* — Volpe and Koenig, P.C.

(57) ABSTRACT

A mixing device (1) including a rotor (6) having pulverizing edges (7) and acting together with pulverizing edges (9) of a stator (8) is provided. The rotor (6) simultaneously executes a feeding effect in the axial direction using pump vanes, and the stator is externally closed in the radial direction. At least one rolling bearing is provided behind the rotor (6) in the feeding direction, the rolling elements (14) thereof inducing further pulverizing of the products processed in the mixing device (1). A further pump vane unit (15) behind the rolling bearing (12) in the feeding direction can preferably improve the flow of the medium, particularly through the rolling bearing (12), and transport the processed medium out of the device (1), preferably in the radial direction.

12 Claims, 2 Drawing Sheets

U.S. PATENT DOCUMENTS

| | | | | |
|---|---|---|---|---|
| 5,829,696 | A * | 11/1998 | DeStefano et al. | 241/169 |
| 6,398,402 | B1 * | 6/2002 | Thomas et al. | 366/129 |
| 6,863,431 | B2 * | 3/2005 | Yacko et al. | 366/129 |
| 7,052,172 | B2 * | 5/2006 | Jahn et al. | 366/293 |
| 7,056,009 | B2 * | 6/2006 | Jagle et al. | 366/129 |
| 7,270,284 | B2 * | 9/2007 | Liao et al. | 241/69 |
| 7,370,819 | B2 * | 5/2008 | Czarnek | 241/2 |
| 2003/0206485 | A1 * | 11/2003 | Yacko et al. | 366/343 |
| 2005/0058019 | A1 * | 3/2005 | Jahn et al. | 366/295 |
| 2005/0190642 | A1 * | 9/2005 | Jagle et al. | 366/129 |
| 2011/0220751 | A1 * | 9/2011 | Jagle | 241/101.8 |

FOREIGN PATENT DOCUMENTS

| | | |
|---|---|---|
| DE | 202004003482 | 6/2004 |
| DE | 102004009708 | 9/2005 |
| DE | 202007007305 | 8/2007 |

* cited by examiner

MIXING DEVICE WITH STATOR HAVING GROOVED PULVERIZING EDGES AND ROTOR FOR PUMPING

BACKGROUND

The invention relates to a mixing device with a rotating drive shaft that supports a pulverizing tool that is formed as a rotor and has pulverizing edges on the outside in the radial direction and can be moved in a rotating manner relative to a stationary stator that is supported, in particular, by a shaft tube and has, on its side, pulverizing edges turned toward the rotor, wherein the pulverizing edges of the rotor and the pulverizing edges of the stator apply a force to, process, or pulverize a medium located between these edges and solids located in the medium and feed it out from the region of the rotor as the rotor rotates.

Such a mixing device is known from DE 10 2004 009 708 B3 and has proven effective. The pulverizing edges of the rotor and stator adjacent to each other in the radial direction cause the desired mixing of a medium fed or suctioned into the rotor region due to the high rotational speed of the rotor and the small distance between these pulverizing edges.

Here, however, the possibility of pulverization is limited, that is, the size of the resulting parts or particles of the mixing process could still not be small enough in some cases.

SUMMARY

Therefore, there is the objective of creating a mixing device of the type defined above with which additional processing of the particles is possible with additional pulverization, without an additional stage made from the rotor and stator being required, but this would also be possible.

For achieving this objective, the mixing device defined above is characterized in that the pulverizing edges of the stator define grooves or slots closed in the radial direction and oriented in the axial direction, that the rotor has a pumping or feeding effect from its axial inlet region in the axial direction, and that behind the mixing region formed from the rotor and stator in the axial feed direction, there is at least one rolling bearing through which the medium can be fed and behind which an outlet is arranged for the processed medium.

In this way, a material to be pulverized or a mixture can be pulverized initially in the conventional way in a mixing region between a rotor and a stator. This pulverized material is then forced through at least one rolling bearing in which it is acted upon by the rolling bodies and even further pulverized accordingly. A correspondingly small particle size or a correspondingly intense mixing result can be achieved just with a single-stage mixing device. Analogously, however, such additional pulverization could also be provided in at least one rolling bearing in a two-stage mixing device. The rolling bearing or bearings themselves could be viewed as additional pulverization stages of the mixing device. Here, the rolling bearing has a double function, because, on one hand, it supports the drive shaft for the rotor and, on the other hand, it causes or supports the pulverization and mixing of the medium and particles located therein.

While in the mixing device according to DE 10 2004 009 708 B3 the pulverizing edges of the rotor and stator are each arranged on an imaginary cylinder, a construction of the invention can provide that the envelope surface enclosing the pulverizing edges of the rotor and/or the envelope surface enclosing the pulverizing edges of the stator have a decreasing cross section or diameter in the approximately axial feed direction. Therefore, the rate of flow in the feed direction can be increased and the feed flow that receives an approximately ring-shaped cross section can be targeted and limited, so that it is led with increasingly high pressure to the rolling bearing or bearings.

Here it is further preferred if the radial distance of the pulverizing edges of the rotor to the pulverizing edges of the stator decreases in the direction of flow or feed. This also contributes to improving the mixing result and accelerating the feed flow or to feeding it with correspondingly high pressure to the rolling bearing or bearings.

One especially preferred and advantageous construction of the mixing device according to the invention can provide that the rotor is formed by inclined vanes projecting in the radial direction on the drive shaft and whose ends oriented in the feed direction are directed toward the rolling bearing. These vanes thus have a double function in that, on one hand, they support the pulverizing edges on their border lying on the outside in the radial direction and, on the other hand, they exert a feeding and pumping effect from the inlet into the mixing device to the rolling bearing or bearings due to their corresponding inclined position.

The outlet from the mixing region formed by rotor and stator can form a ring surface that coincides at least partially with the ring surface or is adjacent to this in the axial direction, wherein this ring surface borders the ring region with the rolling bodies of the rolling bearing, and the slots of the stator and the intermediate spaces between the pulverizing edges of the rotor can open into this ring region. Thus it is guaranteed that the feed flow of the medium processed by the rotor and stator is led to the rolling bodies of the rolling bearing and can enter into the rolling bearing in the axial direction. The vanes of the rotor could be arranged inclined relative to an axial direction and the center axis of the drive shaft—as already mentioned—such that they have a feeding effect in the axial direction from the inlet into the mixing region to the inlet into the rolling bearing or bearings.

As was already indicated, optionally also more than one rolling bearing could be provided, in order to cause an even stronger pulverization of particles. Here it could be preferred if at least one additional rolling bearing is arranged behind the rolling bearing in the feed direction, wherein these rolling bearings can preferably abut each other directly, so that the feed flow can be realized directly from one rolling bearing to the other.

The rolling bearing or bearings essential for the mixing device according to the invention could have different constructions. For example, it is possible that the rolling bearing or bearings is or are formed by rolling bodies guided in a housing between the rotor and stator or have inner and/or outer rings for holding the rolling bodies. Above all, such conventional rolling bearings provided with inner rings and outer rings simplify the assembly.

It is also possible that at least one of the rolling bearings is a ball bearing or barrel-shaped bearing and the balls or barrels are fixed in the axial direction especially on their outside in a circular channel and held without a cage, wherein this channel could be machined directly into the retaining housing, if space is to be saved in the radial direction. However, the outer ring of such an especially conventional rolling bearing could also have the circular channel, in order to avoid a cage for the rolling bodies, wherein this cage could obstruct the entry of medium into the bearing.

For the pulverizing effect, it is favorable if the rolling bodies can be pressed by centrifugal force during their rotation onto the stationary outer side or the outer ring of the rolling bearing and can roll there practically without play and when the bearing play during use is arranged on the side of the rolling bodies lying on the inside in the radial direction. Through these measures, the fact can be taken advantage of that the rolling bodies are subjected to a centrifugal force especially at a high rotational speed and thus can revolve without play on the outer side and can simultaneously free up a pulverizing gap on their side lying on the inside in the radial direction.

For an especially space-saving arrangement, the rolling bearing or bearings could be needle bearings.

Furthermore, space could be saved—as already indicated—in the radial direction such that the shaft tube or housing carrying the stator itself forms the outer ring of the rolling bearing or bearings and/or that the drive shaft contains a circular guide channel for guiding the side of the rolling bodies lying on the inside in the radial direction or carries the inner ring of the rolling bearing.

A long service life and effectiveness can be achieved if the rolling bodies and/or their bearing rings are made from hard ceramic.

Rotors, stators, and/or pumping or feeding devices could also be made from hard ceramic or heat-treated, especially in order to be able to easily withstand abrasive media.

Another advantageous construction increasing the effectiveness of the mixing device according to the invention can provide that, behind the rolling bearing or bearings in the direction of flow, another pumping or feeding device or pump vane unit and in their effective region or behind in the axial direction of flow, at least one radial outlet from the shaft tube or housing of the mixing device is provided. In this case, the medium can then be moved both from the rotor exerting a pumping effect in the direction of flow in front of the rolling bearing or bearings and also by such an additional pump vane unit effectively by the entire mixing device and processed accordingly.

Tests have shown that, above all, such a flow emerging through an additional pump vane unit in the radial direction out from the shaft tube or housing is so strong that a vortex formed by the rotational effect of the mixing device in a stirring vessel is destroyed or prevented by this radial flow. In this way, the risk is also avoided or overcome that the rotor runs with the pulverizing edges completely or partially in the air and then would have no effect.

Primarily from the combination of individual or several of the features and measures described above, an effective mixing device is produced in which the rolling bearing or bearings used for the support of the rotor can be included in the pulverization process. Here, ceramic bearings could also be used that require no lubrication and could even run dry, in order to cause this additional pulverizing effect. Here, the known high temperature resistance of ceramic bearings in an application in a mixing device is also advantageous, because the very high rotational speeds in mixing processes generate a correspondingly high amount of heat; it is often also necessary to process the product for its pulverization under a large amount of heat that is well tolerated by such ceramic bearings.

BRIEF DESCRIPTION OF THE DRAWINGS

Below, an embodiment of the invention will be described in detail with reference to the drawings. Shown in partially schematic representation are.

DETAILED DESCRIPTION OF THE PREFERRED EMBODIMENTS

Figure 2:
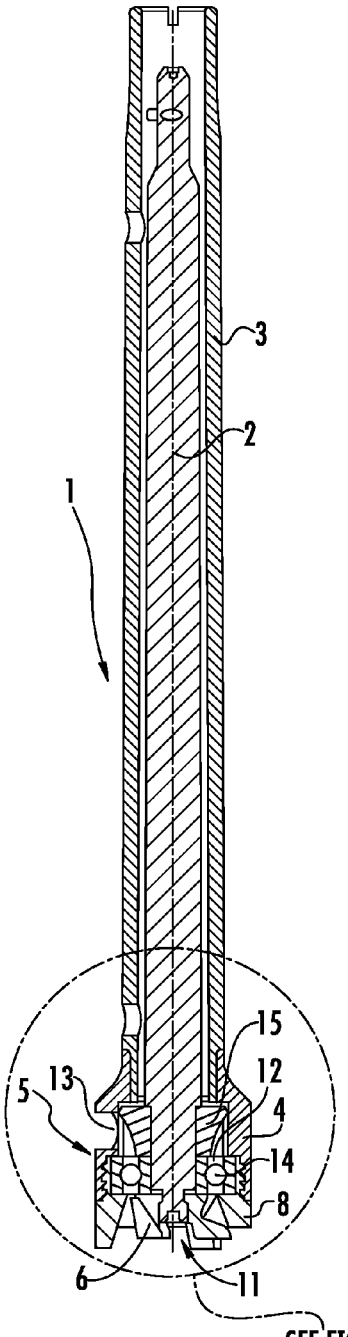
FIG. 2: a longitudinal section view taken along along line 2-2 in FIG. 1 of the mixing device according to the invention—without the drive of the drive shaft located in the interior of the shaft tube—wherein, in the mixing region in the axial direction adjacent to pulverizing edges, a rolling bearing formed as a ball bearing is arranged and axially adjacent thereto, in turn, another pump vane unit is arranged that is located in the region of the side outlets.

A mixing device designated overall with 1, also called "device 1" below, has a drive shaft 2 rotating during use according to FIG. 2, whose drive engages opposite the lower end in the position of use and is not shown in the drawing. This drive shaft 2 is located in a shaft tube 3 that simultaneously also acts as a housing in a way still to be described and is supported on the lower housing 4 in the embodiment, whose outer periphery is greater than that of the shaft tube 3.

Figure 4:
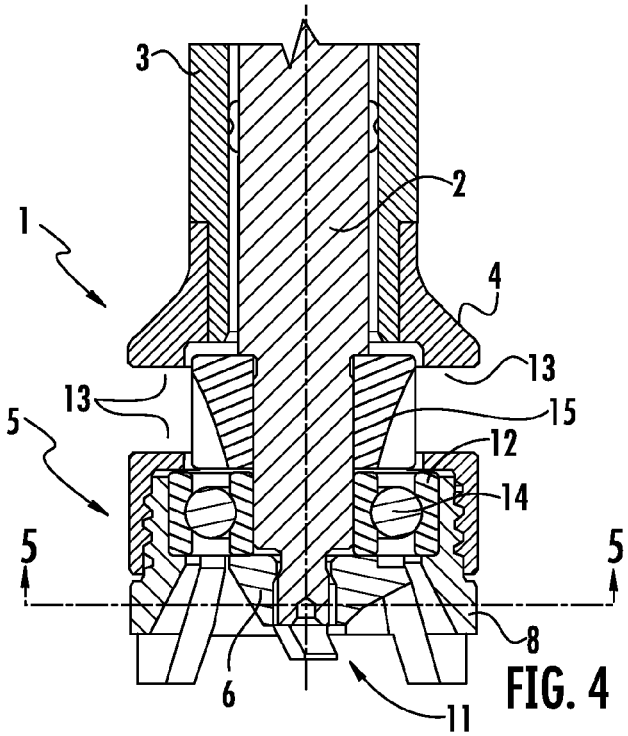
FIG. 4: at an enlarged scale, the detail view indicated in FIG. 2 and here, in particular, a longitudinal section or axial section of the mixing region.
Figure 5:
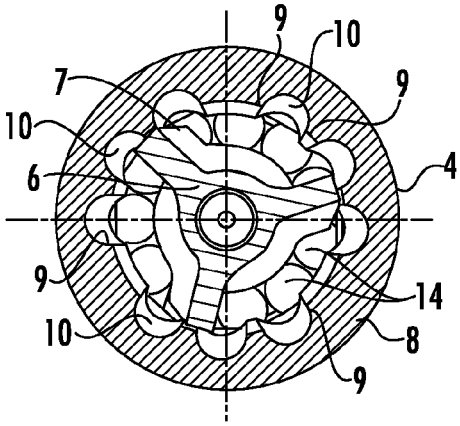
FIG. 5: a cross sectional view through rotor and stator taken along line 5-5 in FIG. 4, as well as FIG. 6: a view of an end side at the lower end of the mixing device with a view onto the axial inlet of a medium to be processed and onto the stirring vanes of the rotor, as well as the pulverizing edges of the stator.
Figure 6:
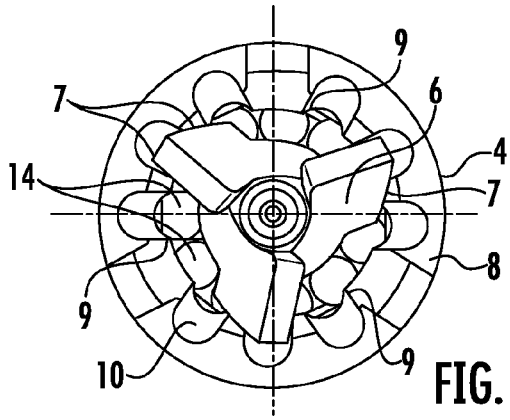

On the lower end in the mixing region 5, the drive shaft 2 supports a pulverizing tool 6 that is formed as a rotor and has pulverizing edges 7 on the outside in the radial direction and can be moved in a rotating manner relative to a stationary stator 8 carried in the shaft tube 3 or in the housing 4 held by this tube. The stator 8 that can be seen especially well in FIGS. 4 to 6 is an essential part of the housing 4 and has, on its side, pulverizing edges 9, wherein the pulverizing edges 7 of the pulverizing tool 6, also called "rotor 6" below, and the pulverizing edges 9 of the stator 8 apply a force to, process, and pulverize a medium located between these edges and solids located in the medium when the rotor 6 rotates. In addition, the medium is transported away with the solids out from the region of the rotor 6, in order to create space for additional medium to be processed and to make possible a continuous pulverizing and mixing process.

With reference to FIGS. 4 to 6, it can be seen that the pulverizing edges 9 of the stator 8 are closed in the radial direction and define grooves 10 or slots that are oriented in the axial direction and here have a somewhat channel-shaped cross section. In a way still to be described, the rotor 6 has a pumping or feeding effect from its axial inlet region 11 at the lower end side of the device 1 in the axial direction, and behind the mixing region 5 formed from the rotor 6 and stator 8 in the axial direction there is a rolling bearing 12 through which the medium is fed as can be easily seen primarily in FIG. 4. Behind the rolling bearing there is an outlet 13 in the radial direction out from the mixing region 5 and out from the housing 4 from which the processed medium can flow approximately in the radial direction.

The medium is thus acted upon and processed initially by the pulverizing edges 7 and the pulverizing edges 9 of rotor 6 and stator 8 and then by the rolling bodies 14 of the rolling bearing 12. Therefore, a more thorough pulverization can be achieved than with the help of only rotor 6 and stator 8.

The—optionally several—rolling bearings 12 are here used simultaneously as a radial and axial bearing point and for pulverization.

FIG. 4 illustrates that an envelope surface enclosing the pulverizing edges 7 of the rotor 6 has an approximately conical or cone-shaped construction and that the envelope surface enclosing the pulverizing edges 9 of the stator 8 also has a conical profile or with a decreasing cross section or diameter approximately in the axial feed direction. Here, the radial distance of the pulverizing edges 7 of the rotor 6 to the pulverizing edges 9 of the stator 8 decrease in this direction of flow or feed, in order to form an effective pulverizing process in the direction of flow.

According to FIG. 4 and especially FIG. 6, the rotor 6 is formed by vanes that are oriented at an angle and project in the radial direction on the drive shaft 2 and whose edges lying on the outside in the radial direction form the pulverizing edges 7 and their ends oriented in the feed direction are directed toward the rolling bearing 12, which is easy to see in FIG. 4. The vanes of the rotor 6 here have an incline relative to an axial direction and relative to the center axis of the drive shaft such that they have a feeding effect in the axial direction from the inlet 11 into the mixing region and to the inlet into the rolling bearing 12. Thus, the rotor 6 has a double function in that it contributes, on one hand, to the pulverization and has, on the other hand, the axial feeding effect. The outlet from the first mixing region formed by rotor 6 and stator 8 forms a ring surface that coincides with the ring surface defining the ring region with the rolling bodies 14 of the rolling bearing 12 and the slots or grooves 10 of the stator 8 and also the intermediate spaces between each of the pulverizing edges 7 of the rotor 6 and the pulverizing edges 9 open into this ring region, so that the flow of the medium to be processed is led selectively into the region of the rolling bodies 14 and can be subjected to further processing by these rolling bodies. Here, the rolling bodies 14 could form a contact with a counter movement, which could have an effect of additional pulverization.

The entire mixing region 5 thus actually has two mixing stages, namely the first stage formed by rotor 6 and stator 8 and the second stage formed by the rolling bearing 12. Accordingly, fine particles can leave the entire mixing region 5.

In a way not shown in more detail, behind the rolling bearing 12 in the feed direction there could be at least one additional such rolling bearing if a better support and even stronger pulverization is desired.

In the embodiment, an essentially conventional ball bearing is provided as a rolling bearing 2 whose rolling bodies 14 are thus balls. Here, the rolling bearing 12 has an inner ring and an outer ring and the channels on these rings guide the balls, so that no cage that could obstruct the flow through the rolling bearing 12 is necessary for these balls. It would also be possible, however, to provide these channels for the rolling bodies directly on the inside of the housing 4 and/or on the drive shaft 2.

The use of the rolling bearing 12 for additional pulverization could be utilized here in that the rolling bodies or balls 14 are pressed outward by centrifugal force during rotation, that is, revolve on the outside without play and thus free up on the inside a gap corresponding to the bearing play for further pulverization.

It is especially favorable when the rolling bearing 12 is a ceramic bearing that requires no special lubrication and can receive high thermal loading.

Figure 1:
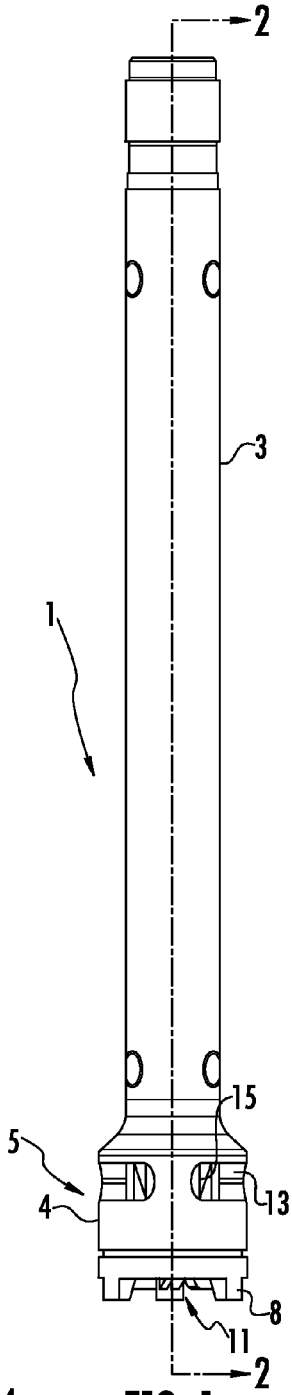
FIG. 1: a side view of a mixing device according to the invention with a shaft tube and a mixing region located on the lower region in the drawing with an axial inlet on the bottom side and a side outlet spaced apart in the axial direction.

In FIGS. 1, 2, and 4, it can be seen that behind the rolling bearing 12 in the direction of flow, there is an additional pumping or feeding device in the form of a pump vane unit 15 in whose region the radial outlet 13 from the housing 4 is adjacently arranged in the radial direction. Thus, the flow through the mixing region 5 and especially also through the rolling bearing 12 is reinforced and can be used to stop or to disrupt a possible vortex formation in a vessel holding the mixing device 1 with the medium and therefore to largely or completely prevent the rotor 6 from running dry.

Figure 3:
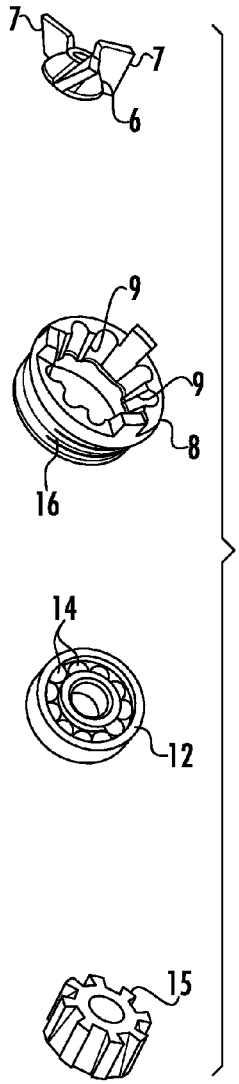
FIG. 3: a pulled-apart view of the individual parts that are arranged essentially adjacent to each other in the mixing region and in an interacting way.

The formation of the individual components of the mixing device is more clearly shown in FIG. 3. The part shown farthest at the top in FIG. 3 is the rotor 6 with its inclined pump vanes whose edges on the outside in the radial direction form the pulverizing edges 7. Underneath, the stator 8 optionally fastened with its thread 16 on the housing 4 can be seen with its inner grooves 10 and the pulverizing edges 9 defining these grooves. Consequently, the rolling bearings 12 used for additional pulverization and for supporting the drive shaft 2, in the embodiment, a ball bearing, is shown and underneath, in FIG. 3, there is also the pump vane unit 15 that has, above all, a radial pumping effect, in order to suction, on one hand, the medium also through the rolling bearing 12 and to feed it, on the other hand, outward in the radial direction. These individual parts are shown in FIG. 3 in the sequence from top to bottom, in which they are assembled in the position of use from bottom to top in the device 1.

The mixing device 1 has a rotor 6 that has pulverizing edges 7 and interacts with pulverizing edges 9 of a stator 8, wherein the rotor 6 simultaneously exerts a feeding effect in the axial direction with the help of pump vanes and the stator is closed outward in the radial direction. Behind the rotor 6 in the feed direction, there is at least one rolling bearing 12 whose roller body 14 causes further pulverization of products processed in the mixing device 1. Preferably, behind the rolling bearing 12 in the feed direction, another pump vane unit 15 can improve the flow of the medium, especially through the rolling bearing 12, and can feed the processed medium preferably in the radial direction out from the device 1.

The invention claimed is:

1. Mixing device (1) comprising a rotating drive shaft (2) that carries a pulverizing tool (6) that is formed as a rotor and has pulverizing edges (7) on an outside thereof in a radial direction and can be moved in a rotating manner relative to a stationary stator (8) that is carried by a shaft tube (3) and has pulverizing edges (9), the pulverizing edges (7) of the rotor (6) and the pulverizing edges (9) of the stator (8) apply a force to, process, or pulverize at least one of a medium located between the pulverizing edges or solids located in the medium when the rotor (6) rotates and feed the medium out from a region of the rotor (6), the pulverizing edges (9) of the stator (8) define grooves (10) or slots that are closed in the radial direction and are oriented in an axial direction, the rotor (6) has a pumping or feeding effect from an axial inlet region thereof in the axial direction, and, in an axial feed direction behind a mixing region formed from the rotor (6) and stator (8) there is at least one rolling bearing (12) through which the medium is feedable and behind which there is an outlet (13) for processed medium.

2. Mixing device according to claim 1, wherein at least one of an envelope surface enclosing the pulverizing edges (7) of the rotor (6) or an envelope surface enclosing the pulverizing edges (9) of the stator (8) have a decreasing cross section or diameter in the axial feed direction.

3. Mixing device according to claim 1, wherein a radial distance of the pulverizing edges (7) of the rotor (6) to the pulverizing edges (9) of the stator (8) decreases in the direction of flow or feed.

4. Mixing device according to claim 1, wherein the rotor (6) is formed by inclined vanes that project in the radial direction on the drive shaft (2) and ends of the inclined vanes oriented in the feed direction are directed toward the rolling bearing (12).

5. Mixing device according to claim 4, wherein the outlet from the mixing region formed by the rotor (6) and stator (8) forms a ring surface that coincides at least partially with a ring surface that defines a ring region with rolling bodies (14) of the rolling bearing (12), and the grooves (10) of the stator (8) and intermediate spaces between the pulverizing edges (7) of the rotor (6) and the pulverizing edges (9) of the stator open into the ring region.

6. Mixing device according to claim 4, wherein the vanes of the rotor (6) are arranged inclined with respect to the axial direction and a center axis of the drive shaft (2) such that the vanes have a feeding effect in the axial direction from the inlet (11) into the mixing region to the inlet into the rolling bearing (12).

7. Mixing device according to claim 1, wherein the rolling bearing or bearings (12) are formed by rolling bodies (14) guided in a housing between rotor (6) and stator (8) or have internal or external rings for holding the rolling bodies (14).

8. Mixing device according to claim 7, wherein at least one of the rolling bearings (12) is a ball bearing or barrel-shaped bearing and balls or barrels thereof are fixed in the axial direction.

9. Mixing device according to claim 7, wherein the rolling bearing or bearings are needle bearings.

10. Mixing device according to claim 7, wherein the shaft tube (3) or housing (4) supporting the stator (8) forms an outer ring of the rolling bearing or bearings (12) or the drive shaft (2) for guiding a side of the rolling bodies (14) on an inside in the radial direction contains a guide channel or carries an inner ring of the rolling bearing (12).

11. Mixing device according to claim 7, wherein the rolling bodies (14) or the bearing rings are made from hard ceramic.

12. Mixing device according to claim 1, wherein an additional pumping or feeding device or pump vane unit (15) is provided behind the rolling bearing or bearings (12) in the direction of flow and the at least one radial outlet (13) from the shaft tube (3) or housing (4) of the mixing device (1) is provided in a region of the additional pumping or feeding device or pump vane unit or behind in the axial direction of flow.

* * * * *